US007618332B2

(12) United States Patent
Sato et al.

(10) Patent No.: US 7,618,332 B2
(45) Date of Patent: Nov. 17, 2009

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/781,624

(22) Filed: Jul. 23, 2007

(65) Prior Publication Data

US 2008/0051224 A1 Feb. 28, 2008

Related U.S. Application Data

(63) Continuation-in-part of application No. 11/148,340, filed on Jun. 9, 2005, now Pat. No. 7,273,426.

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

2007/0026971 A1 2/2007 Aoyama et al.

FOREIGN PATENT DOCUMENTS

JP 10-147097 A 6/1998
JP 2004-243033 A 9/2004

OTHER PUBLICATIONS

Udo Machat, The Golf Ball Book, Sport Images pp. 47, 54-55.*
Udo Machat, The Golf Ball Book, Sport Images, pp. 47, 54, 55.

* cited by examiner

*Primary Examiner*—Raeann Trimiew
(74) *Attorney, Agent, or Firm*—Sughrue Mion, PLLC

(57) ABSTRACT

The present invention provides a golf ball having an outer surface with recessed and/or raised features thereon and having markings shaped as letters or figures formed on the outer surface. The markings are depressions of a substantially uniform depth from the outer surface and are characterized by (1) or (2) below:

(1) letting S be the number of the depressions of a substantially uniform depth from the outer surface and N be the total number of dimples on the outer surface, the ratio S/N×100 is 100% or less;

(2) the markings are circular or elliptical, or are polygonal.

The aerodynamic performance of the golf ball is improved by arranging the depressions of substantially uniform depth evenly on the surface of the ball.

11 Claims, 9 Drawing Sheets

(A)

(B)

GOLF BALL

CROSS-REFERENCE TO RELATED APPLICATION

This application is a continuation-in-part of application Ser. No. 11/148,340 filed on Jun. 9, 2005 now U.S. Pat. No. 7,273,426, the entire contents of which are hereby incorporated by reference.

BACKGROUND OF THE INVENTION

The present invention relates to a golf ball having surface markings such as letters and figures. More particularly, the present invention relates to a golf ball which can be produced with the generation of substantially no defective product in the marking operation.

A golf ball usually has on the surface thereof logo marks indicating, for example, a product name and number in one or more colors. Conventional ways of forming such markings include direct printing by a pad printing process, transfer printing in which a stamp presses a transfer film with a solid covering of ink against the ball, and thermal transfer printing which employs a transfer film composed of a base film on which is formed an ink layer bearing the markings to be transferred. What is common to all of these marking methods is the use of printing ink containing organic or inorganic pigments and the application of external pressure.

However, it is difficult to apply a uniform pressure to the surface of a golf ball which, unlike a smooth spherical surface, has numerous irregularities such as dimples densely arranged thereon. In particular, uneven printing and ink bleed occur at the bottoms of the recessed dimples, giving rise to markings which have unclear boundaries.

In the past, to further increase the distance traveled by golf balls, many investigations have been conducted on the hardness, thickness and material composition of each layer at the interior of the ball, resulting in numerous technical disclosures on the internal construction of golf balls. Yet, there is a limit to what such development can achieve. Another important challenge that has emerged recently is how to make the textured patterns of dimples and other features that are formed on the surface of the ball distinctive and, by further increasing the surface coverage thereof, improve the aerodynamic performance of the ball.

SUMMARY OF THE INVENTION

It is thus an object of the invention to provide a golf ball which does not use conventional inks having the various problems related above, and which possesses a surface of excellent durability that retains well the clarity of markings thereon. Another object of the invention is to provide a golf ball in which the aerodynamic performance due to surface features such as dimples has been further improved, enabling the distance traveled by the ball to be increased.

To achieve the above objects, the inventor has conducted extensive investigations, resulting in the discovery that by employing depressions of substantially uniform depth from the outer surface of a golf ball to form markings such as letters and figures on recessed and/or raised features of the outer surface instead of resorting to the use of conventional printing inks containing organic or inorganic pigments, the clear visibility of the markings can be retained for substantially the entire life of the ball.

The inventor has also found that by optimizing the number of depressions of substantially uniform depth and the number of dimples on the surface of the ball and arranging the depressions and dimples in a good balance, the surface coverage by such dimples and depressions can be increased and the aerodynamic performance of the golf ball thereby enhanced. These discoveries ultimately led to the present invention.

Accordingly, the invention provides the following golf balls.

[I] A golf ball with an outer surface having recessed and/or raised areas formed thereon and markings shaped as letters or figures formed on the outer surface, wherein said markings are composed of depressions of a substantially uniform depth from the outer surface and, letting S be the number of such depressions of a substantially uniform depth from the outer surface and N be the total number of dimples, the ratio $S/N \times 100$ is 100% or less.

[II] The golf ball of [I], wherein the markings include some having a contour length in a range of 10 to 55 mm.

[III] The golf ball of [I], wherein the markings are formed of rectilinear and/or curvilinear elements.

[IV] A golf ball with an outer surface having recessed and/or raised features formed thereon and markings shaped as letters or figures formed on the outer surface, wherein the markings are circular or elliptical and composed of depressions of a substantially uniform depth from the outer surface.

[V] A golf ball with an outer surface having recessed and/or raised features formed thereon and markings shaped as letters or figures on the outside surface, wherein the markings are polygonal and composed of depressions of a substantially uniform depth from the outer surface.

DETAILED DESCRIPTION OF THE INVENTION

The invention is described more fully below.

Figure 1:
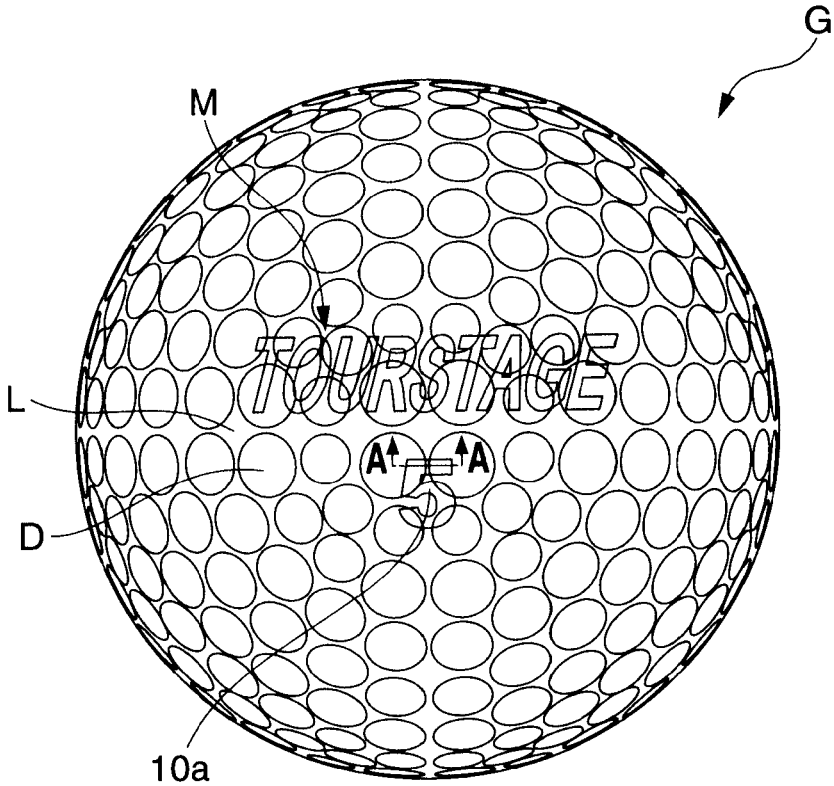
FIG. 1 is a front view of a golf ball according to the invention.
Figure 2:
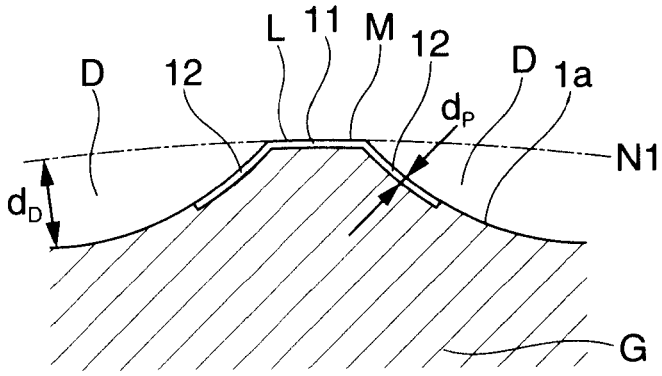
FIG. 2 is a partial sectional view, taken along A-A in FIG. 1, showing the vicinity of the outer surface of the golf ball in FIG. 1.

FIG. 1 is a front view of a golf ball illustrating a first embodiment of the first aspect of the invention. FIG. 2 is a sectional view, taken along A-A, of a portion of the markings formed on the ball in FIG. 1.

Referring to FIG. 1, a golf ball G has numerous dimples D arranged on the spherical surface thereof by an ordinary method, and has lands L formed at places on the spherical surface between the dimples (at those positions on the surface located furthest from the center of the ball in the radial direction). The dimples shown in FIG. 1 are circular as viewed from above; however, the dimples may be elliptical, oval or polygonal so long as they function as golf ball dimples.

The markings M formed on the surface of the ball in FIG. 1 are alphabetic characters, and typically indicate the trade name of the golf ball. The numeral '5' shown in FIG. 1 represents the number of the golf ball. These markings M composed of, for example, a trade name and a number are formed as depressions 10*a* which are substantially uniform over the entire ball 1*a*. As a result, the markings can be clearly recognized, even without coloration thereof, by light reflection which varies due to differences in shape between the dimples D and the surrounding lands L.

In the present invention, the depressions 10*a* which form the markings M, when viewed three-dimensionally, have a shape like that shown in FIG. 2. Referring to FIG. 2, a depression 10*a* which forms a marking M has a depth $d_p$ that is substantially uniform throughout. That is, the depth $d_p$ from the surface is substantially uniform at both a portion 11 of the depression situated on the land L and at portions 12 of the depression situated on the dimples that extend therefrom. Here, "depth $d_p$ from the surface" refers to the depth in the direction normal to the curved surface that forms the land L or dimple D. This depth $d_p$ is preferably not more than 0.12 mm, and more preferably not more than 0.09 mm. At a depth $d_p$ in excess of 0.12 mm, the markings may adversely affect the flight performance of the golf ball, depending on the size and arrangement of the markings on the surface of the ball. The lower limit of the depth $d_p$ should preferably be 0.015 mm. The dimples generally have a depth of from 0.2 to 0.4 mm. Hence, the depth $d_p$ of the depressions is much smaller than the depth $d_D$ of the dimples.

Figure 3:
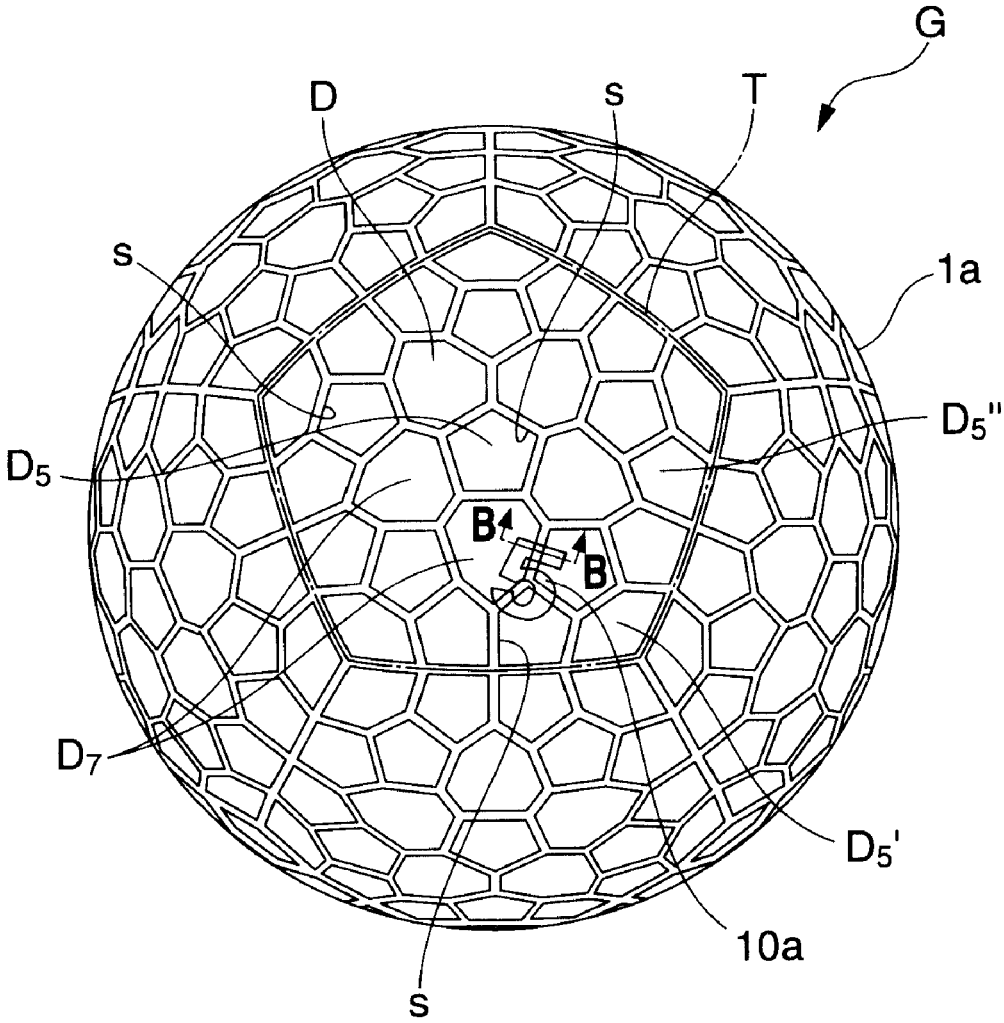
FIG. 3 is a front view of another golf ball according to the invention.
Figure 4:
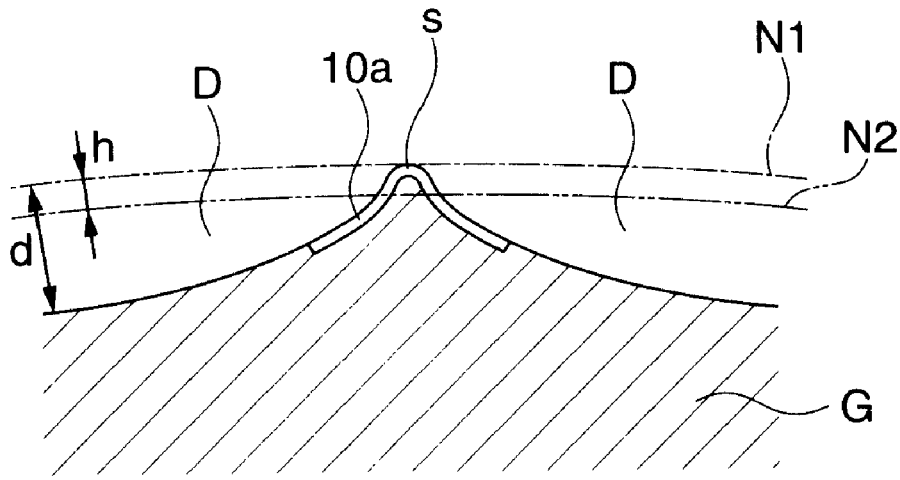
FIG. 4 is a partial sectional view, taken along B-B in FIG. 3, showing the vicinity of the outer surface of the golf ball in FIG. 3.

FIG. 3 is a front view of a golf ball showing a second embodiment of the first aspect of the invention. FIG. 4 is a sectional view, taken along B-B, of a portion of the markings formed on the ball in FIG. 3.

This embodiment is characterized in that numerous dimples D, defined by dimple edges s which extend in a polygonal pattern as viewed from above are formed on the ball surface 1*a*. In addition, depressions 10*a* which express a marking are formed from one dimple to another across dimple edges. More specifically, as shown in FIG. 3, the golf ball according to this embodiment has polygonal dimples D arranged evenly over the entire surface of the ball, each dimple D being enclosed by a polygonal shape composed of a plurality of rectilinearly extending edges s. The ball is assumed here to be a spherical dodecahedron; for the sake of convenience, only one of the unit pentagons T making up this spherical dodecahedron is indicated by a dash-dot line. This unit pentagon T has uniformly disposed therein 26 dimples D of differing sizes centered about a pentagonal dimple $D_5$. The dimples D are arranged as follows. The pentagonal dimple $D_5$, which is substantially similar in shape to the unit pentagon T, is situated at the center of the unit pentagon T in such a way that each side of the pentagonal dimple $D_5$ is parallel to the corresponding side of the unit pentagon T. In addition, five heptagonal dimples $D_7$ are situated around the pentagonal dimple $D_5$ with the latter at the center. A pentagonal dimple $D_5'$ is arranged at each of the five vertices, or corners, of the unit pentagon T so as to be inscribed within the sides of the unit pentagon T. Three additional pentagonal dimples $D_5''$ are arranged in a well-balanced manner between the pentagonal dimple $D_5'$ at each corner within the unit pentagon T and the heptagonal dimples $D_7$. As a result, the unit pentagon T has disposed therein a total of 26 dimples consisting of 21 pentagonal dimples $D_5$, $D_5'$ and $D_5''$ and five heptagonal dimples $D_7$, bringing the total of pentagonal dimples and heptagonal dimples arranged over the entire surface of the golf ball to 312.

In this embodiment, as shown in FIG. 4, each edge s is formed between an imaginary line N1, indicated in the diagram by a dash-dot line, which represents the outer periphery of the ball and a reference line N2, indicated by a dash-dot-dot line, which is smaller than the imaginary line N1 by exactly a distance h and extends concentrically thereto. The edge s has a cross-sectionally arcuate shape which projects out from the ball. The dimples D have concave shapes which extend into the ball from the reference line N2. The pairs of parallel lines which indicate edges s in FIG. 3 denote reference point positions where the edge s intersects the reference line N2 in FIG. 4.

Referring again to FIG. 4, in this embodiment, the depression 10*a* which forms a marking M is shaped so as to extend into the dimples D and D to the left and right of the edge s therebetween. The distance h between the reference line N2 and the imaginary line N1 which represents the outer periphery of the ball and connects the apices of the edges s (i.e., which distance indicates the height of the edge s) is preferably about 0.15 mm. The dimple depth d, inclusive of this distance h, should be suitably adjusted within a range of 0.3 to 0.5 mm.

Figure 5:
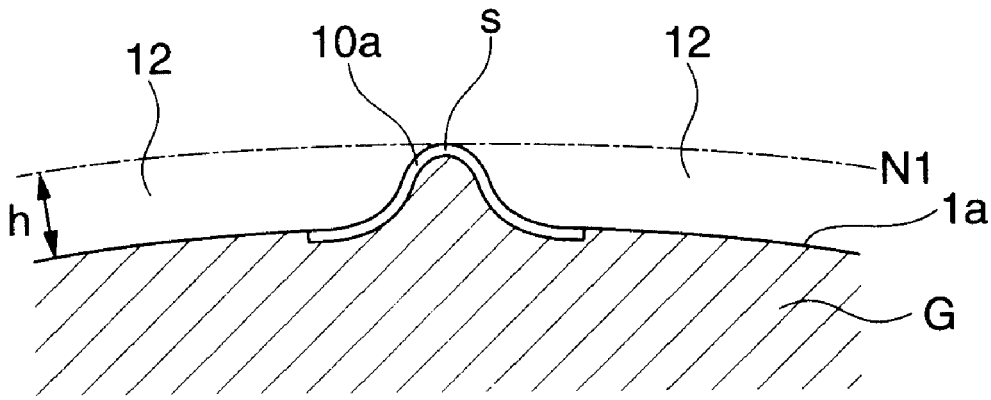
FIG. 5 is a partial sectional view showing another example of a marking formed on the outer surface of the ball.

FIG. 5 shows another embodiment of the first aspect of the present invention. The golf ball in FIG. 5 is characterized in that the edges s used in the foregoing embodiment are arranged to form polygonal or non-circular regions 12 on the spherical surface of the ball, and a depression 10*a* which forms a marking M is arranged on the spherical surface 1*a* so as to extend to the left and right of the edge s therebetween. The depression 10*a* is substantially identical in structure and shape with that shown in FIGS. 3 and 4. As in the embodiment shown in FIG. 4, the imaginary line M, which represents the ball periphery and connects the apices of the edges s, is located at the furthest position in the radial direction from the center of the ball G and is concentric with the outer surface of the ball corresponding to the spherical surface 1*a*.

Figure 6:
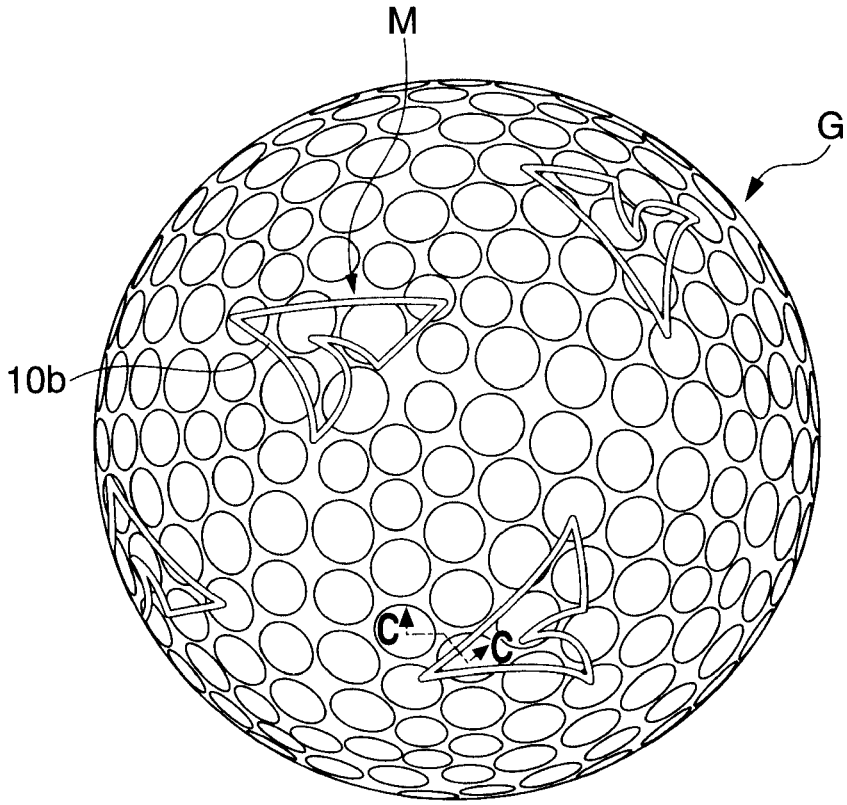
FIG. 6 is a front view of yet another golf ball according to the invention.
Figure 7:
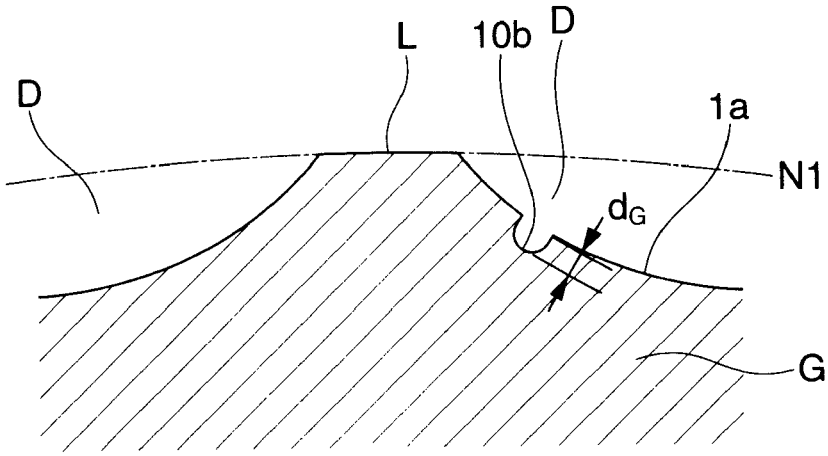
FIG. 7 is a partial sectional view, taken along C-C in FIG. 6, showing the vicinity of the outer surface of the golf ball in FIG. 6.

FIG. 6 is a front view of a golf ball according to a first embodiment of the second aspect of the invention. FIG. 7 is a sectional view, taken along C-C in FIG. 6, showing a portion of the marking M formed on the surface of the ball in FIG. 6.

The second aspect of the invention, similar to the first aspect of the invention, pertains to a golf ball G on which grooves 10*b* form markings M such as letters and figures on the outer surface of a ball having raised and/or recessed features thereon. The golf ball is characterized in that the markings M are formed by grooves 10*b* having a substantially uniform depth from the outer surface 1*a* of the ball.

In the example shown in FIG. 6, V-shaped markings M are formed by grooves 10*b*, and the markings M are placed in a well-balanced, substantially uniform arrangement over the entire surface of the ball. As with the depth of the depressions

10*a* in the first aspect of the invention, the grooves 10*b* have a depth $d_G$ which is preferably not more than 0.12 mm, and more preferably not more than 0.09 mm, The lower limit in the groove depth $d_G$ is preferably 0.015 mm. The grooves 10*b* have a cross-sectional shape which is not subject to any particular limitation. For example, the cross-sectional shape may be arcuate as shown in FIG. 7, V-shaped, U-shaped, or polygonal. No particular limitation is imposed on the maximum width of the groove, although it is preferable to adjust the maximum width so that it is either about the same as the groove depth or is about two to three times greater than the depth.

In the first and second aspects of the present invention, when the grooves 10*b* which form the markings M are set to a substantially uniform depth no greater than 0.012 mm, it is unlikely that the grooves will have an adverse influence in terms of balance during the flight of the ball when played. Even so, it is desirable that the markings M be arranged in a well-balance manner on the outer surface 1*a* of the ball. For example, by using a known method of arrangement in which the surface of the ball is treated as a spherical polyhedron such as an icosahedron, dodecahedron or octahedron, the markings M can be displayed evenly over the entire surface of the ball, improving the aesthetic appearance of the ball G. Alternatively, when the above markings M are arranged along the equator and/or meridians of the ball G, the markings M can be used as putting targets on the ball during play.

In the practice of the invention, letting S be the number of depressions of a substantially uniform depth from the outer surface of the ball and letting N be the total number of dimples on the outer surface of the ball, the ratio of S to N (S/N) must be 100% or less, and is preferably 90% or less, more preferably 70% or less, and even more preferably 50% or less. Outside of the above range, that is, if the depressions are arranged on the surface of the ball in a greater number than the dimples, the balance between the depressions and the dimples will worsen. The upper limit in the ratio S/N, while not subject to any particular limitation, is preferably 3% or higher. By thus optimizing in the present invention the number of depressions S and the number of dimples N and arranging the depressions and dimples evenly on the surface of the ball, the surface coverage by the dimples and depressions can be increased, enabling the aerodynamic performance of the golf ball to be improved.

Concerning the meaning of the term 'depression' used in the present specification, a region enclosed by a single contour shall be defined herein as a single depression. The number of depressions on the surface of a golf ball corresponds to the number of such regions.

A marking formed by a substantially uniform depression has a contour length of preferably 55 mm or less, more preferably 45 mm or less, and even more preferably 35 mm or less. The upper limit in the contour length is preferably at least 10 mm, more preferably at least 15 mm, and even more preferably at least 20 mm.

To effectively achieve the objects of the invention, it is preferable for markings with contour lengths in a range of 10 to 55 mm to account for at least 10%, more preferably at least 30%, even more preferably at least 50%, and most preferably at least 80%, of all the markings. It is even acceptable for markings having such contour lengths to account for 100% of the markings.

The markings may have a shape that is circular, elliptical or polygonal. Alternatively, they may be arcuate, with the use of shapes that form part of a circle being especially preferred. Elliptical shapes are defined herein as shapes which are distorted to a certain degree from a true circular shape, and include also shapes having rectilinear segments located between curvilinear segments. Polygonal shapes refer herein to geometrically polygonal shapes. Specifically, suitable use can be made of polygonal shapes selected from among triangular, quadrangular, pentagonal, hexagonal, heptagonal, octagonal and hexadecagonal shapes. Such polygons preferably have curves (R) at the vertices thereof. This makes it possible to minimize the drag which acts on the ball in flight, enabling the distance traveled by the ball to be improved.

Figure 9:
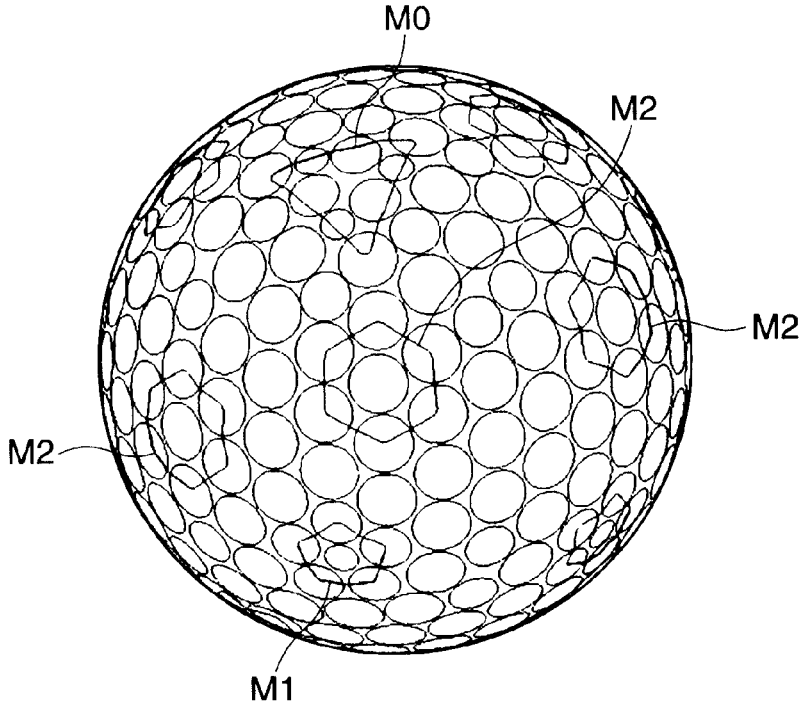
FIG. 9 is a front view of the golf ball of Example 1 according to the invention.
Figure 10:
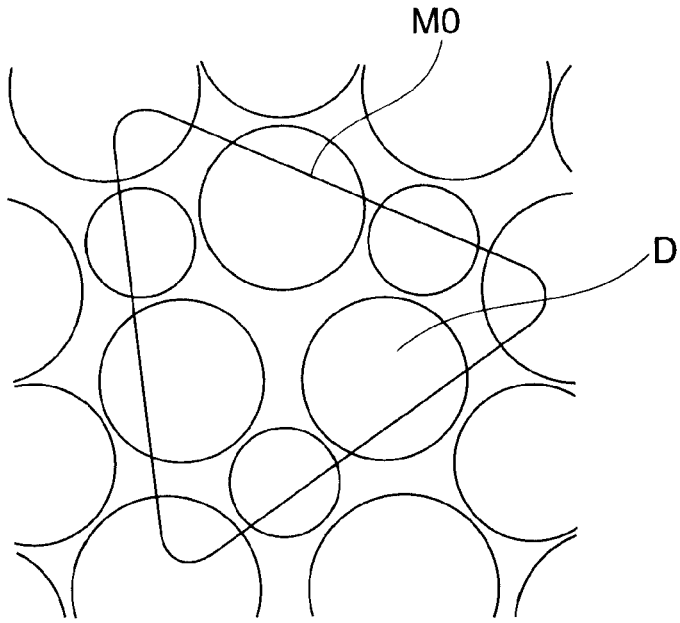
FIG. 10 are enlarged views showing portions of the ball surface bearing markings in FIG. 9.
Figure 10:
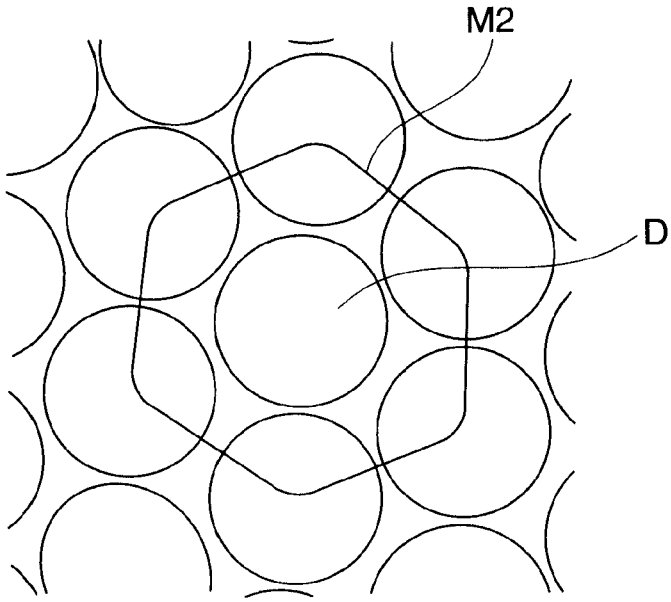

The golf ball shown in FIG. 9 is one example in which the above markings are polygons. The markings M formed on the surface of this golf ball are triangles, pentagons and hexagons. These respective markings M0, M1 and M2 are arranged in a well-balanced manner on the surface of the ball so as to intersect with a plurality of dimples. FIGS. 10A and 10B show enlarged views of these markings. As is apparent from the diagrams, curves (R) are provided at the vertices of these markings.

Figure 11:
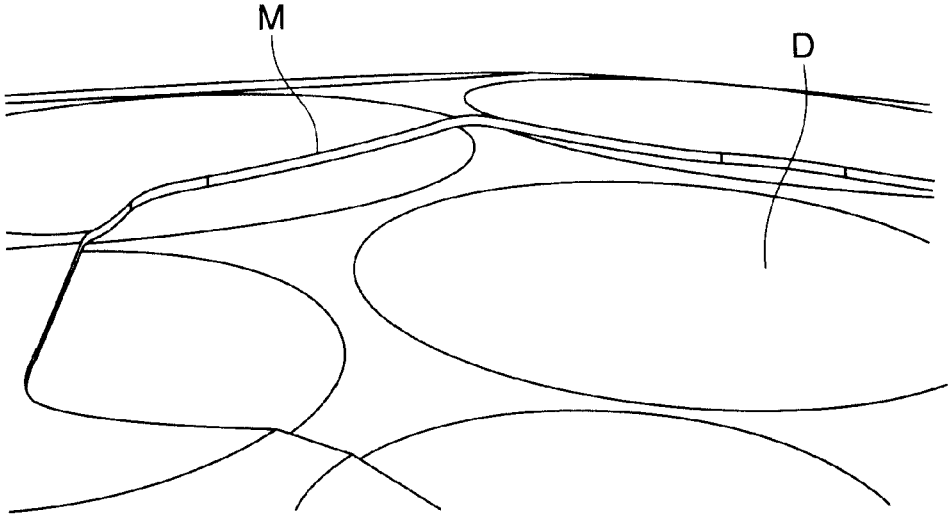
FIG. 11 is a perspective view depicting grooves on a portion of the ball surface which appear as a marking.

The above-described markings are formed of depressions which are of substantially uniform depth from the outer surface of the ball. As shown in FIG. 11, these depressions correspond to relatively shallow grooves which have been cut across a plurality of dimples. Here, the grooves must be substantially uniform on the lands and on the inside faces of the dimples.

Figure 12:
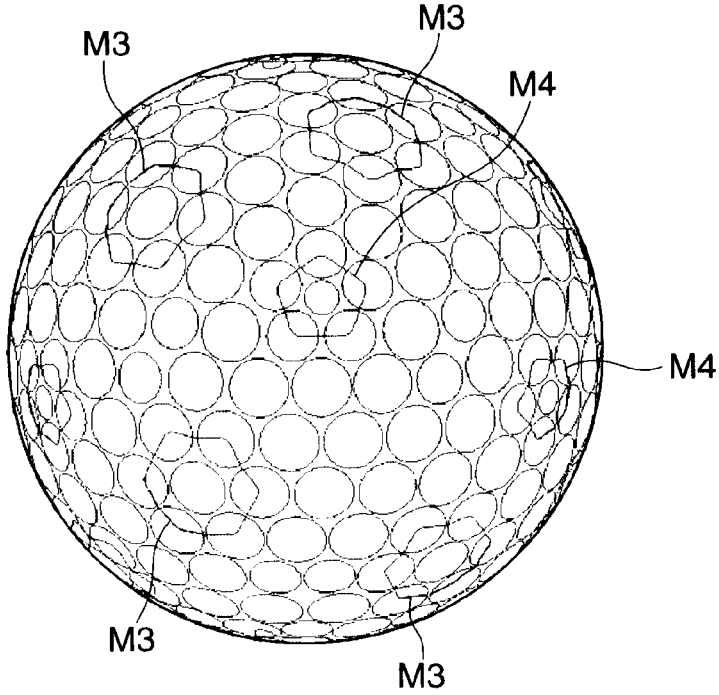
FIG. 12 is a front view of the golf ball of Example 2 according to the invention.
Figure 13:
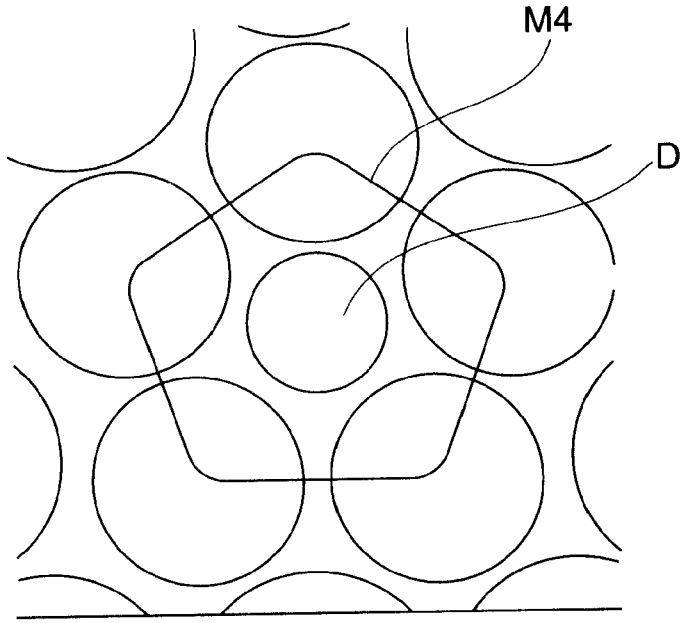
FIG. 13 is an enlarged view showing a portion of the ball surface bearing markings in FIG. 12.

FIG. 12 shows other types of markings. In FIG. 12, relatively large hexagonal markings M3 and relatively small pentagonal markings M4 are arranged uniformly on the surface of the ball. As shown in FIG. 13, these markings M3 and M4 have a pentagonal or hexagonal shape that surrounds a single circular dimple D.

Figure 14:
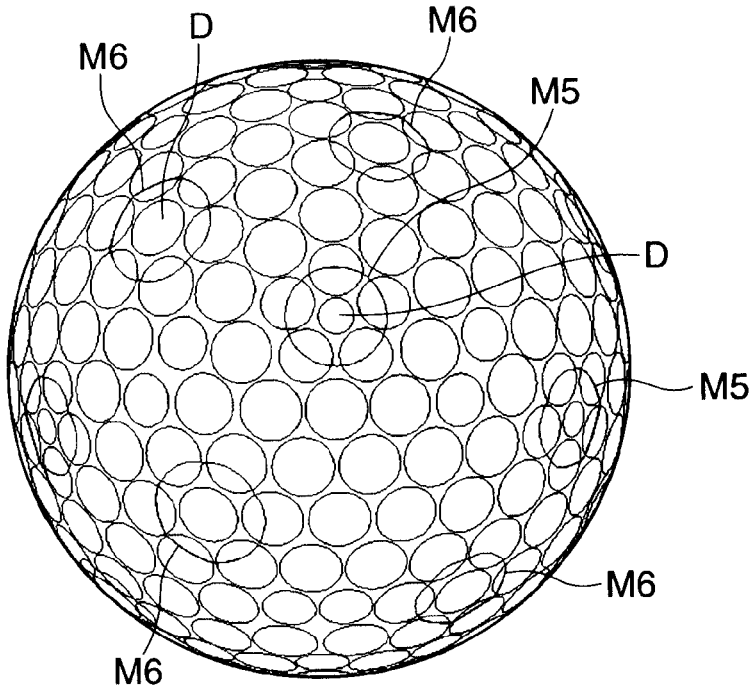
FIG. 14 is a front view of the golf ball of Example 3 according to the invention.
Figure 15:
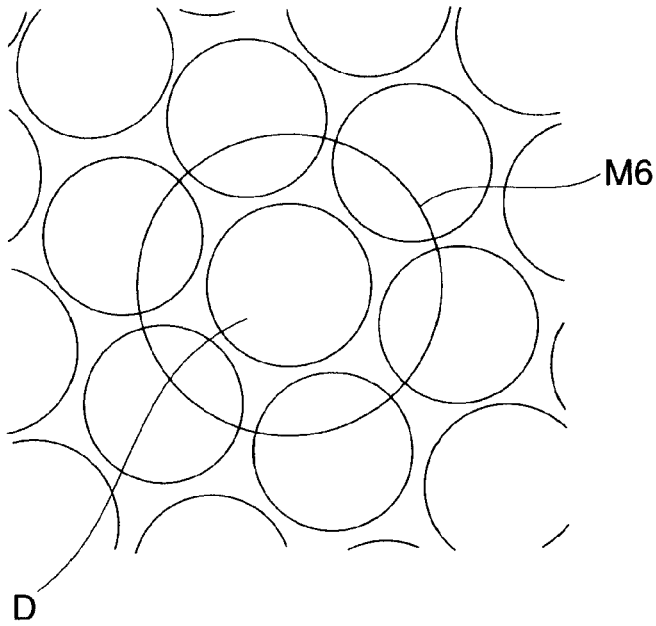
FIG. 15 is an enlarged view showing a portion of the ball surface bearing markings in FIG. 14.

FIG. 14 shows still other types of markings in the form of small and large circles M5 and M6 which intersect five or six dimples. These circular markings M5 and M6 are arranged so as to surround a single circular dimple D.

In the present invention, the markings are not limited to the polygonal markings and circular markings shown in FIGS. 9 to 15. Nor is the manner in which the markings are arranged on the surface of the golf ball limited to the arrangements shown in the diagrams. Suitable design modifications may be made in the arrangement and other attributes of the markings insofar as they do not depart from the gist of the invention. Also, it is desirable that the method used for evenly arranging the depressions and dimples on the surface of the ball be a known method of arranging dimples, such as a rotationally symmetric arrangement or a regular polyhedral arrangement.

The markings M may be formed on the ball surface 1*a* by providing on the walls of the mold cavity in a golf ball mold, together with raised and recessed features for the dimples, projections that correspond to the depressions 10*a* and grooves 10*b* which form the markings, and using the resulting mold to carry out injection molding. The mold may be fabricated in the usual way using three-dimensional CAD/CAM, either by directly cutting the entire surface shape three-dimensionally into a master mold from which the golf ball mold is subsequently made by pattern reversal, or by directly cutting three-dimensionally the walls of the mold cavity for the golf ball mold.

The golf balls of the invention do not impede the placement on the ball surface of patterns formed by conventional printing methods.

The golf balls according to the present invention are not limited to the foregoing embodiments and may be suitably modified with regard to the shapes and arrangement of raised and recessed features such as dimples formed on the ball surface, the types and positions of markings and in other respects without departing from the spirit and scope of the invention. In addition, the golf ball according to the present invention is not subject to any specific limitation as to its construction. For example, it may be a solid golf ball such as a one-piece golf ball, a two-piece golf ball or a multi-piece golf ball having three or more layers. The core and cover may be made of any known thermoplastic resin or thermoplastic elastomer (e.g., rubber, ionomer resin, polyester elastomer, urethane resin), and may have thicknesses and hardnesses that are adjusted as desired. The total weight and diameter of the golf ball may be suitably set in accordance with the Rules of Golf, although generally the diameter is not less than 42.67 mm and the weight is not more than 45.93 g.

As explained above, in the golf ball of the present invention, markings composed of letters and/or figures such as a trade name and a number may be placed on the surface of a golf ball without resorting to conventional printing with ink. Such markings can stay clearly legible for a long period of time.

The golf ball of the invention also optimizes the number of substantially uniform depressions and dimples on the surface of the ball and, by arranging them evenly, increases the surface coverage of the depressions and dimples, enabling the aerodynamic performance of the golf ball to be improved.

EXAMPLES

Examples of the invention and comparative examples are given below by way of illustration and not by way of limitation.

Examples 1 to 3, Comparative Example 1

Figure 8:
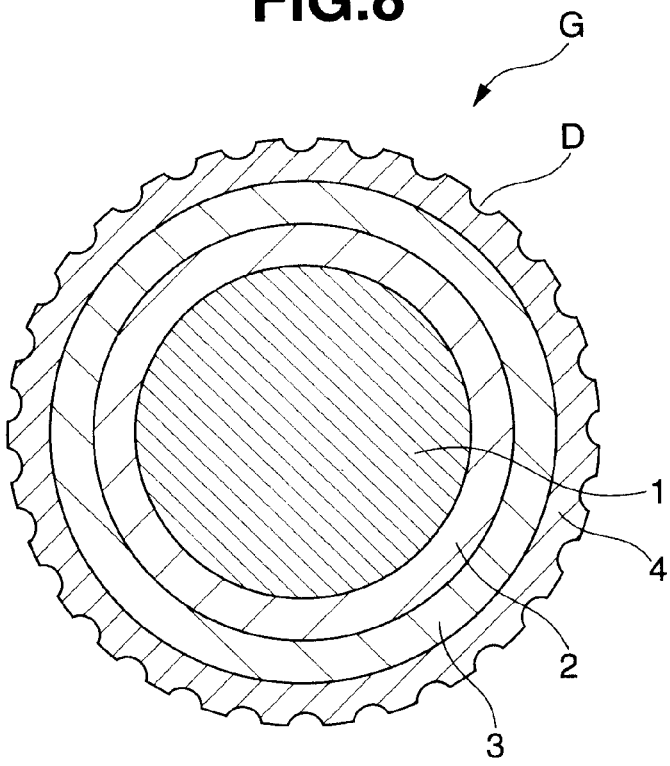
FIG. 8 is a cross-sectional view showing an example of the internal construction of a golf ball.

Core compositions were prepared using the common formulation shown in Table 1, following which the rubber cores were produced by molding and vulcanization at 155° C. for 15 minutes. An envelope layer, an intermediate layer and a cover (outermost layer) were injection-molded in this order over the core using resin materials Nos. 1 to 3 shown in Table 2 below, thereby producing the four-piece solid golf ball shown in FIG. 8. The reference symbols in FIG. 8 stand for the following: G, golf ball; 1, core; 2, envelope layer; 3, intermediate layer; and 4, cover. Specific dimples D were formed on the surface of the cover 4. Details on the constructions of the golf balls in the respective examples and the comparative example are shown in Table 3. The dimple arrangements are shown in Table 4 and FIGS. 9, 12, 14 and 16. The flight performances of the golf balls were measured. Those results are presented in Table 4.

TABLE 1

| | | |
|---|---|---|
| Core formulation (pbw) | Polybutadiene | 100 |
| | Zinc acrylate | 32.5 |
| | Peroxide | 1.2 |
| | Antioxidant | 0.1 |
| | Zinc oxide | 28.7 |
| | Zinc salt of pentachlorothiophenol | 1 |
| Vulcanization | Temperature (° C.) | 155 |
| | Time (min) | 15 |

Trade names of materials appearing in Table 1 are given below.

Polybutadiene: Manufactured by JSR Corporation under the trade name "BR 730."

Antioxidant: 2,2-Methylenebis(4-methyl-6-butylphenol) manufactured by Ouchi Shinko Chemical Industry Co., Ltd. under the trade name "Nocrac NS-6."

Peroxide: A mixture of 1,1-di(t-butylperoxy)cyclohexane and silica, manufactured by NOF Corporation under the trade name "Perhexa C40."

TABLE 2

| | Formulation | | |
|---|---|---|---|
| | No. 1 | No. 2 | No. 3 |
| Himilan 1605 | 68.75 | 50 | |
| Himilan 1557 | | 15 | |
| Himilan 1706 | | 35 | |
| Himilan 1707 | | | |
| Dynaron 6100P | 31.25 | | |
| Behenic acid | 18 | | |
| Calcium hydroxide | 2.3 | | |
| Calcium stearate | 0.15 | | |
| Zinc stearate | 0.15 | | |
| Trimethylolpropane | | 1.1 | |
| Polytail H | 2 | | |
| T-8295 | | | 75 |
| T-8290 | | | 25 |
| T-8260 | | | |
| Hytrel 4001 | | | 15 |
| Titanium oxide | | | 3.5 |
| Polyethylene wax | | | 1.5 |
| Isocyanate compound | | | 9 |

Trade names of materials appearing in Table 2 are given below. All numbers in the table indicate parts by weight.

| | |
|---|---|
| Himilan: | An ionomer produced by DuPont-Mitsui Polychemicals Co., Ltd. |
| Dynaron 6100P: | A hydrogenated polymer produced by JSR Corporation. |
| Hytrel: | A polyester elastomer produced by Dupont-Toray Co., Ltd. |
| Behenic acid: | NAA222-S (beads), produced by NOF Corporation. |
| T-8260, T-8290, T-8295: | MDI-PTMG type thermoplastic polyurethanes produced by DIC Bayer Polymer under the trademark "Pandex." |
| Polyethylene wax: | Sanwax 161P, produced by Sanyo Chemical Industries, Ltd. |
| Isocyanate compound: | 4,4'-Diphenylmethane diisocyanate |

TABLE 3

| | | |
|---|---|---|
| Core | Diameter (mm) | 34.95 |
| | Weight (g) | 27.25 |
| | Surface hardness (Shore D) | 56 |
| Envelope layer material | Material | No. 1 |
| | Thickness (mm) | 1.70 |
| | Specific gravity | 0.93 |
| | Sheet hardness (Shore D) | 56 |
| Envelope layer-covered sphere | Surface hardness (Shore D) | 61 |
| | Diameter (mm) | 38.35 |
| | Weight (g) | 34.14 |
| Intermediate layer material | Material | No. 2 |
| | Thickness (mm) | 1.15 |
| | Sheet hardness (Shore D) | 62 |
| Intermediate layer-covered sphere | Surface hardness (Shore D) | 70 |
| | Diameter (mm) | 40.65 |
| | Weight (g) | 39.50 |
| Cover material | Material | No. 3 |
| | Thickness (mm) | 1.03 |
| | Sheet hardness (Shore D) | 52 |
| Ball | Diameter (mm) | 42.70 |
| | Weight (g) | 45.50 |

TABLE 4

Figure 16:
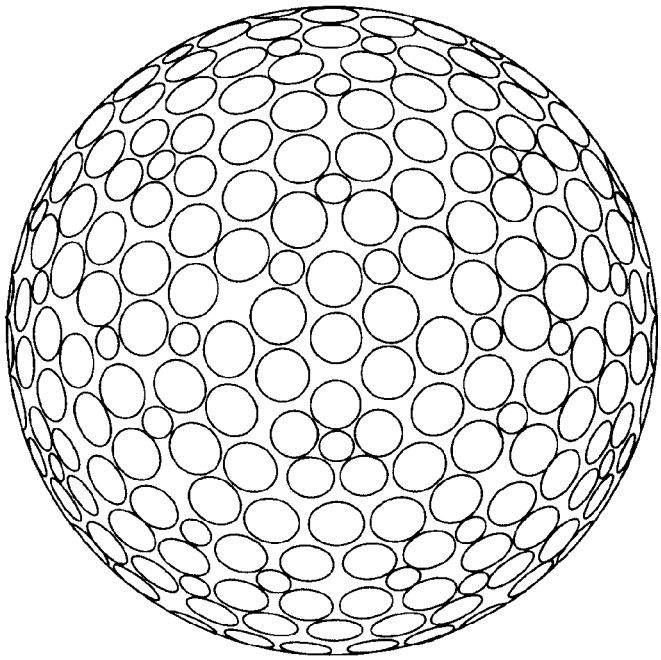
FIG. 16 is a front view showing the golf ball of the comparative example.

| | | | Example | | | Comparative Example |
|---|---|---|---|---|---|---|
| | | | 1 | 2 | 3 | 1 |
| Dimple pattern arrangement | | | FIG. 9 | FIG. 12 | FIG. 14 | FIG. 16 |
| Total number of dimples N | | | 330 | 330 | 336 | 432 |
| Depressions | Circular | | 0 | 0 | 20 | 432 |
| of sub- | Non-circular | | 20 | 20 | 0 | 0 |
| stantially | Circular 1 | Contour length (mm) | — | — | 21.99 | — |
| uniform | | Number | — | — | 14 | — |
| depth | Circular 2 | Contour length (mm) | — | — | 25.13 | — |
| (shape and | | Number | — | — | 6 | — |
| number S) | Non-circular 1 | Contour length (mm) | 27.60 | 27.60 | — | — |
| | (hexagonal) | Number | 12 | 14 | — | — |
| | Non-circular 2 | Contour length (mm) | 19.87 | 19.87 | — | — |
| | (pentagonal) | Number | 6 | 6 | — | — |
| | Non-circular 3 | Contour length (mm) | 33.16 | — | — | — |
| | (triangular) | Number | 2 | — | — | — |
| S/N × 100 (%) | | | 6.1 | 6.1 | 6.1 | 0 |
| Markings with contour length of 10 to 55 mm | | | 100 | 100 | 100 | 0 |
| W#1, HS 45 m/s | | Carry (m) | 218 | 219.5 | 220 | 217 |
| (launch angle, 10°) | | Total distance (m) | 237 | 238.5 | 240 | 236.5 |

Flight Performance

The ball was hit at a head speed of 45 m/s and a launch angle of 10° by a driver (W#1) mounted on a swing robot, and the distance traveled by the ball was measured.

As is apparent from the results in Table 4, the golf balls obtained in Examples 1 to 3 on which markings were formed by depressions of a substantially uniform depth from the outer surface of the ball traveled farther than the golf ball obtained in Comparative Example 1. This showed that the well-balanced arrangement of substantially uniform depressions on the surface of the golf balls in the examples according to the invention improved the aerodynamic performance of the ball.

The invention claimed is:

1. A golf ball comprising an outer surface having dimples on the outer surface, and recessed and/or raised features shaped as letters or figures formed on the outer surface, wherein said recessed features are comprised of depressions of a substantially uniform depth from the outer surface and, letting S be the number of said depressions of a substantially uniform depth and N be a total number of dimples on the outer surface, the ratio S/N×100 is from 3 to 100%, and at least a portion of the recessed and/or raised features extend across a land area between adjacent dimples and into a portion of the adjacent dimples.

2. The golf ball of claim 1, wherein at least 10% of said recessed and/or raised features have a contour length in a range of 10 to 55 mm.

3. The golf ball of claim 1, wherein said recessed and/or raised features are formed of rectilinear and/or curvilinear elements.

4. The golf ball of claim 1, wherein the depth of the depressions is from 0.015 to 0.12 mm.

5. The golf ball of claim 1, wherein the recessed and/or raised features are arranged in a well balanced manner on the outer surface of the golf ball.

6. A golf ball comprising an outer surface having recessed and/or raised features shaped as letters or figures formed on the outer surface, wherein said recessed features are circular or elliptical and comprised of depressions of a substantially uniform depth from the outer surface, wherein the outer surface has dimples and at least a portion of the recessed and/or raised features extend across a land area between adjacent dimples and into a portion of the adjacent dimples.

7. The golf ball of claim 6, wherein the depth of the depressions is from 0.015 to 0.12 mm.

8. The golf ball of claim 6, wherein the recessed and/or raised features are arranged in a well balanced manner on the outer surface of the golf ball.

9. A golf ball comprising an outer surface having recessed and/or raised features shaped as letters or figures formed on the outer surface, wherein said recessed features are polygonal and comprised of depressions of a substantially uniform depth from the outer surface, wherein the outer surface has dimples and at least a portion of the recessed and/or raised features extend across a land area between adjacent dimples and into a portion of the adjacent dimples.

10. The golf ball of claim 9, wherein the depth of the depressions is from 0.015 to 0.12 mm.

11. The golf ball of claim 9, wherein the recessed and/or raised features are arranged in a well balanced manner on the outer surface of the golf ball.

* * * * *